US005445076A

United States Patent [19]

Sugiyama et al.

[11] Patent Number: 5,445,076

[45] Date of Patent: Aug. 29, 1995

[54] CYLINDER THROW APPARATUS

[75] Inventors: Hiroyuki Sugiyama; Norio Hirose, both of Ibaragi, Japan

[73] Assignee: Komori Corporation, Tokyo, Japan

[21] Appl. No.: 124,814

[22] Filed: Sep. 21, 1993

[30] Foreign Application Priority Data

Oct. 1, 1992 [JP] Japan ..... 4-073898 U

[51] Int. Cl.[6] ..... B41F 13/24

[52] U.S. Cl. ..... 101/218; 101/247; 101/185

[58] Field of Search ..... 101/217, 218, 247, 143, 101/144, 145, 182, 184, 185, 139, 140, 137, 139; 100/47, 168, 169

[56] References Cited

U.S. PATENT DOCUMENTS

| | | | |
|---|---|---|---|
| 2,586,975 | 2/1962 | Messinger | 74/395 |
| 3,817,174 | 6/1974 | Paulson | 101/218 |
| 4,676,158 | 6/1987 | Ishii et al. | 101/218 |
| 4,815,377 | 3/1989 | Skiera | 101/218 |
| 5,081,927 | 1/1992 | Jahn | 101/218 |
| 5,109,768 | 5/1992 | Lübke et al. | 101/247 X |
| 5,142,981 | 9/1992 | Dettinger et al. | 101/218 X |
| 5,167,187 | 12/1992 | Dettinger et al. | 101/218 |
| 5,235,910 | 8/1993 | Tafel | 101/218 |
| 5,265,529 | 11/1993 | Tafel | 101/218 |
| 5,272,975 | 12/1993 | Dettinger et al. | 101/218 |

FOREIGN PATENT DOCUMENTS

| | | | |
|---|---|---|---|
| 2611164 | 2/1987 | France . | |
| 1113220 | 8/1961 | Germany . | |
| 1238488 | 4/1967 | Germany . | |
| 3707996C1 | 10/1988 | Germany . | |
| 0134244 | 6/1988 | Japan | 101/218 |
| 0323039 | 11/1992 | Japan | 101/218 |

OTHER PUBLICATIONS

Patent Abstracts of Japan, vol. 012, No. 381 (M-751) Oct. 12, 1988 & JP-A-63 134 244 (Mitsubishi Heavy Ind Ltd.) Jun. 6, 1988.

Patent Abstracts of Japan, vol. 013, No. 287 (M-844) Jun. 30, 1987 & JP-A-01 080 539 (Shinano Kenshi KK) Mar. 27, 1989.

Patent Abstracts of Japan, vol. 011, No. 258 (M-618) Aug. 21, 1987 & JP-A-62 064 552 (Toray Ind Inc.) Mar. 23, 1987.

Patent Abstracts of Japan, vol. 014, No. 144 (M-0951) Mar. 19, 1990 & JP-A-02 009 636 (Mitsubishi Heavy Ind Ltd) Jan. 12, 1990.

*Primary Examiner*—Chris A. Bennett

*Attorney, Agent, or Firm*—Blakely, Sokoloff, Taylor & Zafman

[57] ABSTRACT

A cylinder throw apparatus includes a plate cylinder, a printing cylinder, a blanket cylinder, a pair of eccentric bearings, and a motor. The plate cylinder has a circumferential surface on which a printing plate is mounted. The printing cylinder is disposed to have a circumferential surface thereof kept away from the circumferential surface of the plate cylinder. The blanket cylinder is disposed between the plate cylinder and the printing cylinder. The eccentric bearings and the motor move the blanket cylinder between an impression-on position in which the blanket cylinder is pressed against the plate cylinder and, through a paper sheet, pressed against the printing cylinder, and an impression throw-off position in which the blanket cylinder is kept away from the plate cylinder and the printing cylinder, and automatically set a gap between the blanket cylinder and the printing cylinder at the impression-on position in correspondence with a paper thickness.

4 Claims, 7 Drawing Sheets

CYLINDER THROW APPARATUS

BACKGROUND OF THE INVENTION

The present invention relates to a cylinder throw apparatus for various types of printing presses such as an offset rotary press or intaglio printing press, which presses/separates a printing cylinder such as a blanket cylinder or impression cylinder against/from a corresponding cylinder, and at the same time, automatically controls a gap between the printing cylinder and its corresponding cylinder in correspondence with a paper thickness.

As shown in FIGS. 5 and 6, for example, an offset rotary press comprises a plate cylinder 1, a blanket cylinder 2, and an impression cylinder 3. A printing plate is mounted on the circumferential surface of the plate cylinder 1. The blanket cylinder 2 having a blanket mounted on its circumferential surface is in contact with the plate cylinder 1 during the printing operation. The impression cylinder 3 is in contact with the blanket cylinder 2 during the printing operation. Of these printing cylinders 1, 2, and 3, the plate cylinder 1 and the impression cylinder 3 have shafts rotatably supported, through bearings (none are shown), on left and right frames 5 provided to a printing unit 4, respectively. A shaft 6 of the blanket cylinder 2 is rotatably supported by eccentric bearings 7 (to be described later in detail) fitted in the left and right frames 5. More specifically, the positions of the shafts of the plate cylinder 1 and the impression cylinder 3 are fixed with respect to the left and right frames 5. On the other hand, the position of the shaft 6 of the blanket cylinder 2 is movable with respect to the left and right frames 5.

A swing lever 9 and an L-shaped cam lever 10 are integrally pivotally supported by a stud 8 projecting outward from one of the frames 5 near the end shaft of the impression cylinder 3. A lever shaft 11 having two ends axially supported on the left and right frames 5 is located above the stud 8. A coupling lever 13 coupled to the swinging end of the swing lever 9 by a bar 12 is axially mounted on one projecting portion of the lever shaft 11.

Another coupling lever 14 is axially mounted on the other projecting portion of the lever shaft 11. Cam followers 15 and 16 are pivotally mounted on the fork-like swinging end portions of the cam lever 10, respectively. The cam followers 15 and 16 are respectively in contact with the outer circumferential cam surfaces of two cams 17 and 18, both of which are supported on one of the frames to be rotated.

The above-described eccentric bearings 7 comprise outer eccentric bearings 71 and inner eccentric bearings 72, respectively. The outer eccentric bearings 71 comprise housings 19 pivotally fitted in bearing holes 5*a* in the frames 5, and inner rings 22 rotatably fitted, through needle rollers 21, in outer rings 20 fitted and held on the housings 19. The inner eccentric bearings 72 use the inner rings 22 as outer rings (to be referred to as outer rings 22 hereinafter) and comprise the outer rings 22 and inner rings 24 rotatably fitted in the outer rings 22 through conical rollers 23, respectively.

The distal end portions of handles 25 supported on the frames 5 are pivotally mounted on the housings 19, respectively. When the handles 25 are manually rotated to be moved, the outer eccentric bearings 71 are pivoted. One of bearing levers 26 fixed on the outer rings 22 of the inner eccentric bearings 72 is coupled to the coupling lever 13 by a rod 27. When the cam 17 is rotated, the inner eccentric bearings 72 are pivoted through the cam lever 10 or the like.

FIG. 7 shows movements of the axes of the blanket cylinder 2 and the eccentric bearings 7 when the eccentric bearings 7 are pivoted. This operation will be described with reference to FIGS. 5 and 6. Referring to FIG. 7, the axis of the blanket cylinder 2 when the blanket cylinder 2 is in contact with the plate cylinder 1 and the impression cylinder 3, i.e., in a so-called impression-on state is indicated by reference symbol B.

When the blanket cylinder 2 is to be separated from the plate cylinder 1 and the impression cylinder 3 to obtain a so-called impression throw-off state upon ending of the printing operation, the cams 17 and 18 are pivoted so that the inner eccentric bearings 72 slide along the outer rings 22 to be pivoted. In this case, the axis of the blanket cylinder 2 is moved on the arc centered on the axis M from the position indicated by reference symbol B to the position indicated by reference symbol $B_2$ in FIG. 7 since the axis of the outer rings 22, indicated by reference symbol M, and the axis B of the blanket cylinder 2 are offset from each other. As a result, a gap indicated by reference symbol $S_1$ in FIG. 7 is formed between the blanket cylinder 2 and the plate cylinder 1 while a gap indicated by reference symbol $S_2$ in FIG. 7 is formed between the blanket cylinder 2 and the impression cylinder 3.

If thin paper 26 is replaced with thick paper having a thickness indicated by reference symbol T in FIG. 7, the operator grips and operates the handles 25 to pivot the outer eccentric bearings 71. In this case, the axis M of the outer rings 22 of the inner eccentric bearings 72 is moved on the arc centered on the axis F from the position indicated by reference symbol M to the position indicated by reference symbol $M_2$ because the axis of the housings 19, indicated by reference symbol F, and the axis M of the outer rings 22 of the inner eccentric bearings 72 are offset from each other. As a result, a gap indicated by reference symbol $T_1$ in FIG. 7 is formed between the blanket cylinder 2 and the impression cylinder 3, thereby obtaining a proper printing pressure for the thick paper.

In the conventional cylinder throw apparatus as described above, however, the cams 17 and 18 and many levers for transmitting the rotation of the both cams to the eccentric bearings 7 are required. In addition, since the eccentric bearings 7 comprise the outer eccentric bearings 71 and the inner eccentric bearings 72, the structure is complicated to cause an increase in number of components. It is also difficult to automatize the whole apparatus so that the operator load is increased. Furthermore, because the paper thickness adjustment operation is separately required, the preparation time cannot be shortened, thereby degrading the operating ratio of the printing press.

A cylinder throw apparatus in which eccentric bearings are pivoted by driving a motor to perform an impression-on/impression throw-off operation of a blanket cylinder axially supported by the eccentric bearings with respect to a plate cylinder and an impression cylinder is disclosed in Japanese Utility Model Laid-Open No. 56-26249. In this cylinder throw apparatus, however, a paper thickness adjusting mechanism for adjusting a gap between the blanket cylinder and the impression cylinder in correspondence with the paper thickness is not incorporated in the motor drive system. For this reason, the operator must manually pivot other eccentric bearings in correspondence with the paper thickness so that adjustment is cumbersome, and the structure is complicated. In addition, in the above cylinder throw apparatus, not the blanket cylinder but its corresponding cylinder, i.e., the impression cylinder is moved for paper thickness adjustment. No problem is posed in use of a web rotary press. However, in a sheet-fed press, when the impression cylinder corresponding to the blanket cylinder is moved for paper thickness adjustment, the relative positions of the grippers of the impression cylinder and the grippers of a transfer cylinder in contact with the impression cylinder are changed. Therefore, transfer of the paper between the transfer and impression cylinders becomes unstable.

SUMMARY OF THE INVENTION

It is an object of the present invention to provide a cylinder throw apparatus capable of performing cylinder throw and paper thickness adjustment in a single driving apparatus by a simple structure.

It is another object of the present invention to provide a cylinder throw apparatus capable of automating cylinder throw and the paper thickness adjustment operation.

It is still another object of the present invention to provide a cylinder throw apparatus capable of reducing the operator load and improving the operating ratio of the printing press.

In order to achieve the above objects of the present invention, there is provided a cylinder throw apparatus comprising a plate cylinder having a circumferential surface on which a printing plate is mounted, a printing cylinder disposed to have a circumferential surface thereof kept away from the circumferential surface of the plate cylinder, a blanket cylinder disposed between the plate cylinder and the printing cylinder, and driving means for moving the blanket cylinder between an impression-on position in which the blanket cylinder is pressed against the plate cylinder and, through a paper sheet, pressed against the printing cylinder, and an impression throw-off position in which the blanket cylinder is kept away from the plate cylinder and the printing cylinder, and automatically setting a gap between the blanket cylinder and the printing cylinder at the impression-on position in correspondence with a paper thickness.

BRIEF DESCRIPTION OF THE DRAWAINGS

DESCRIPTION OF THE PREFERRED EMBODIMENT

Figure 1:
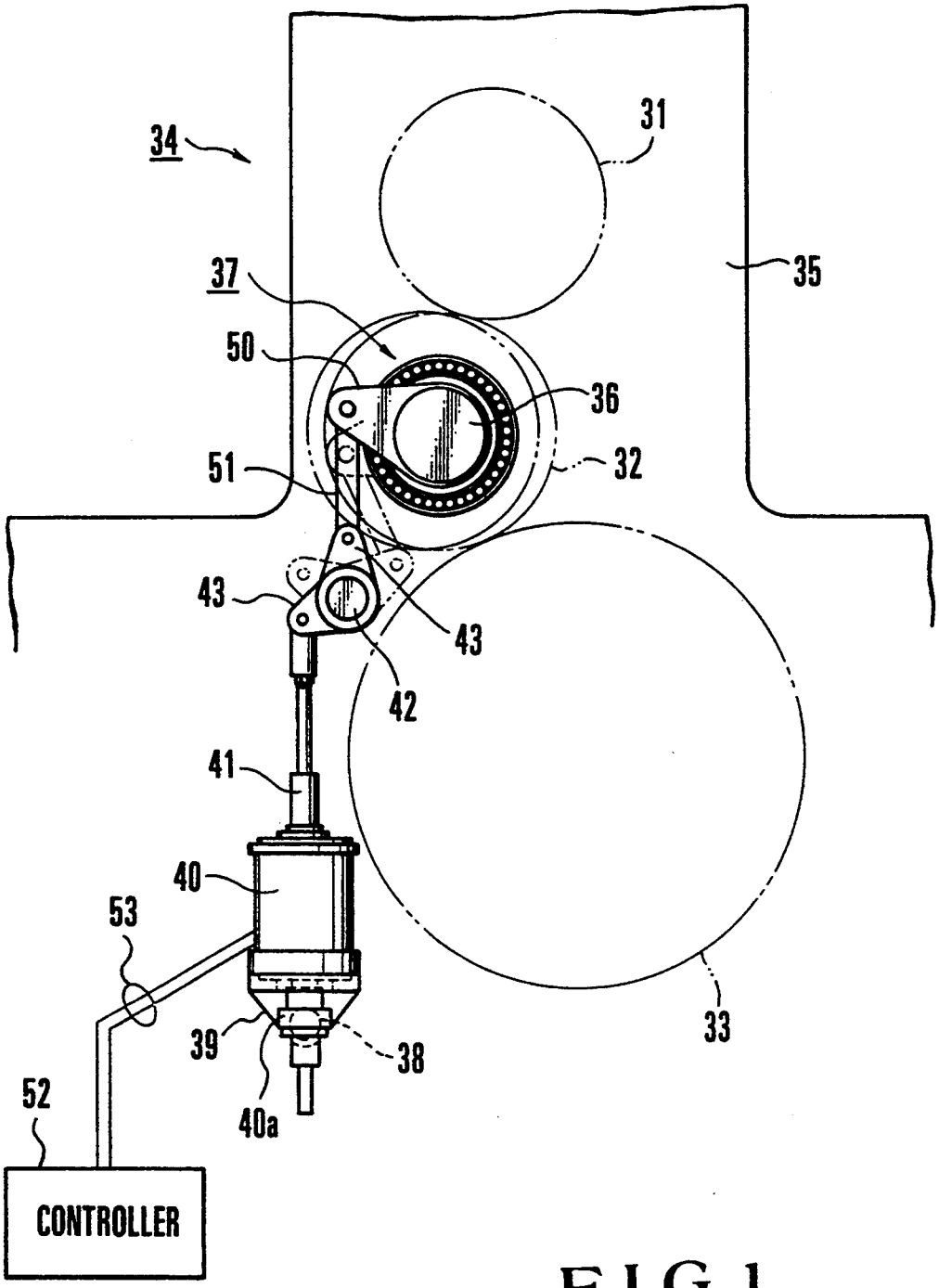
FIG. 1 is a side view showing a cylinder throw apparatus according to an embodiment of the present invention.
Figure 2:
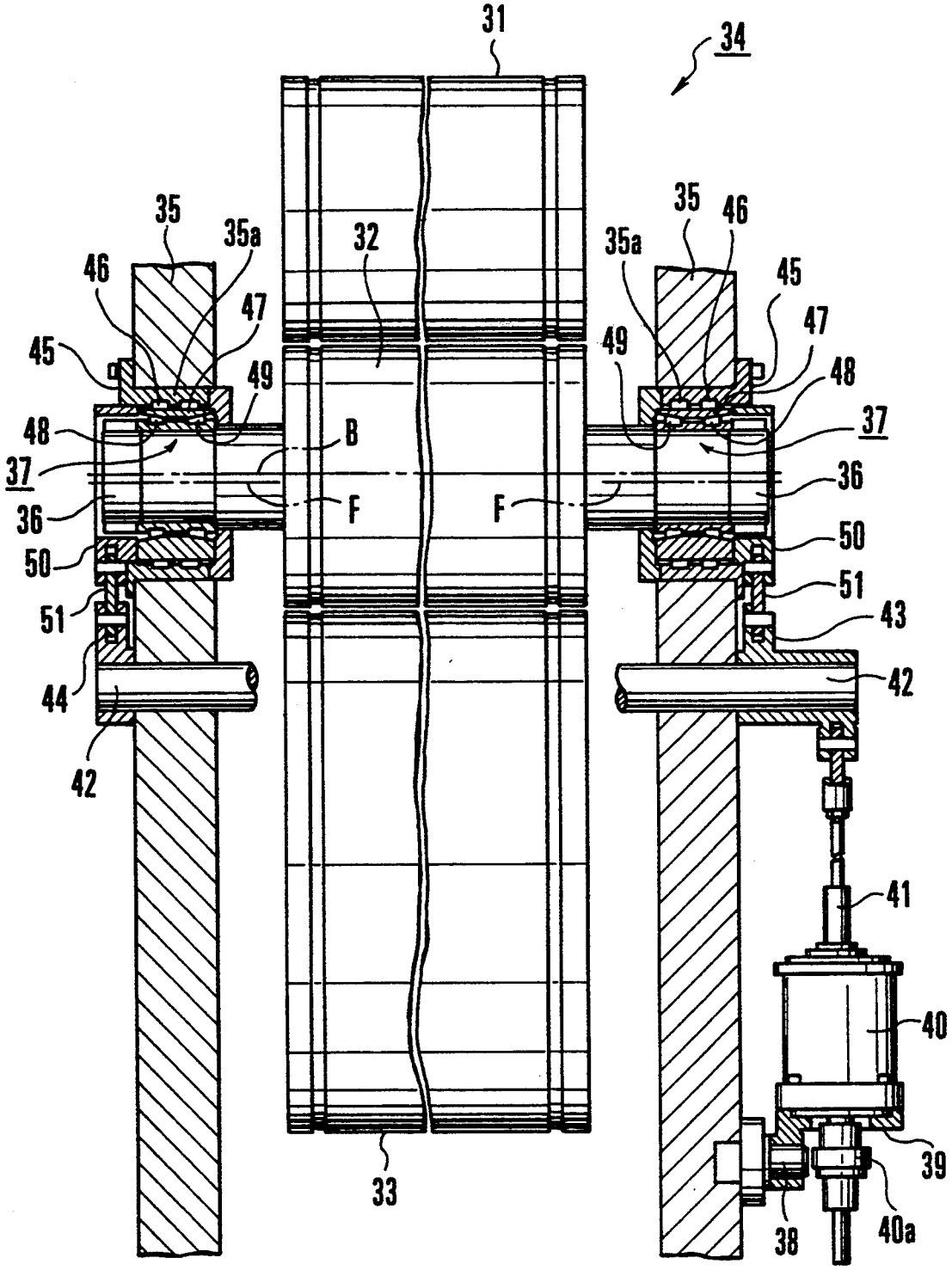
FIG. 2 is a partially cutaway developed front view showing the cylinder throw apparatus according to the embodiment of the present invention.
Figure 3:
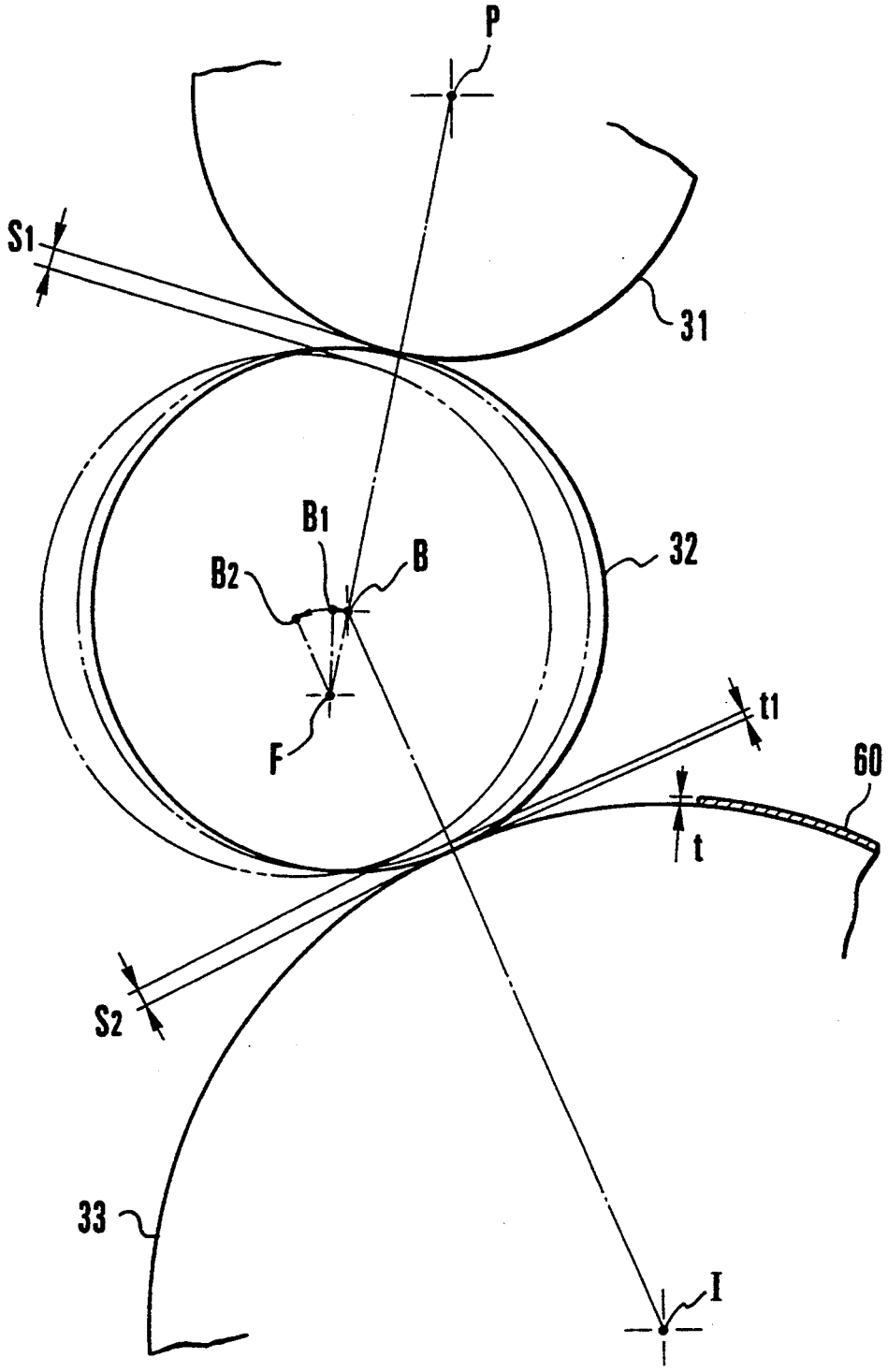
FIG. 3 is a schematic side view for explaining the movement of the axis of a blanket cylinder by the pivotal movement of eccentric bearings in FIGS. 1 and 2.
Figure 4:
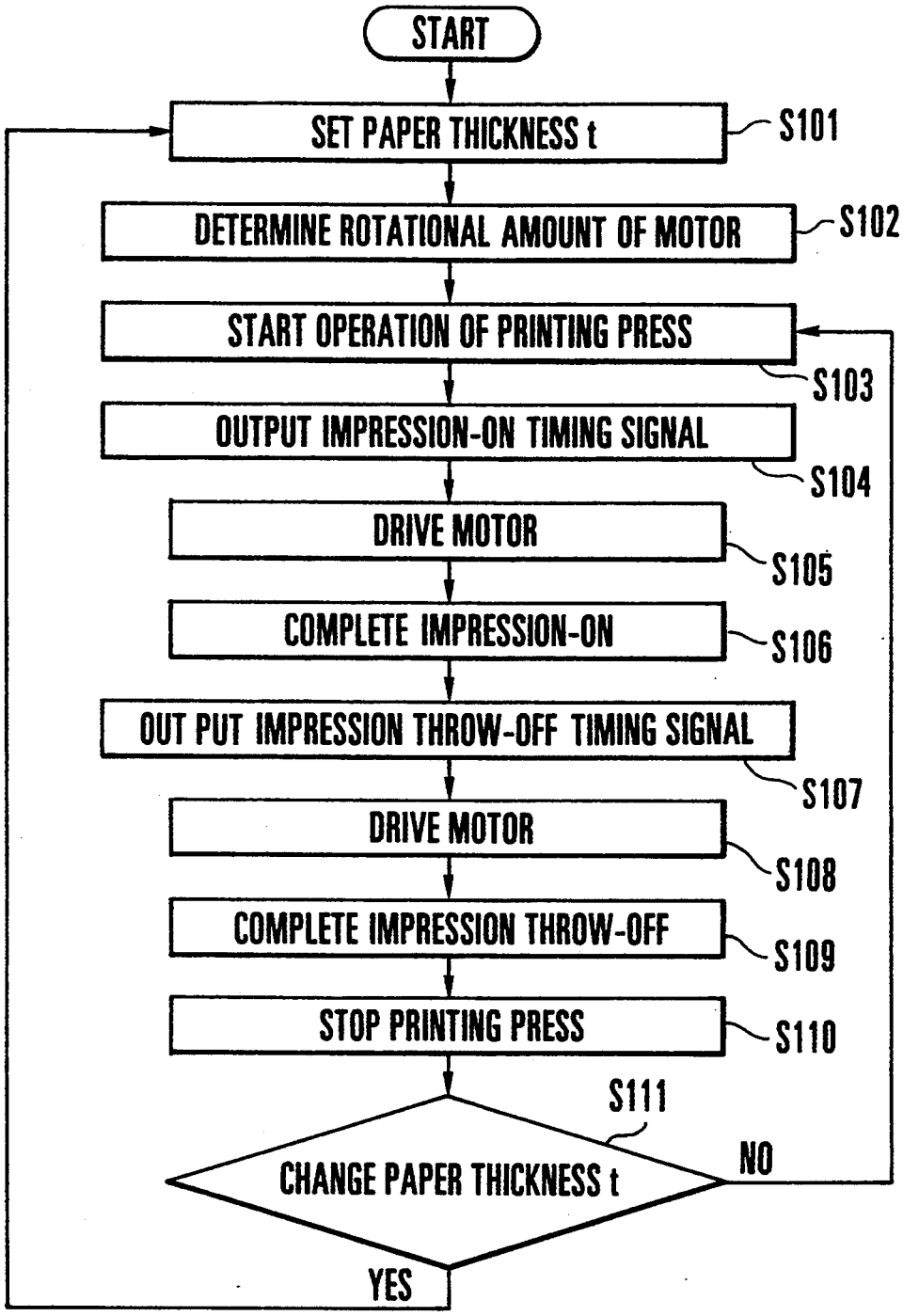
FIG. 4 is a control flow chart showing an operation of the cylinder throw apparatus of the present invention.
Figure 5:
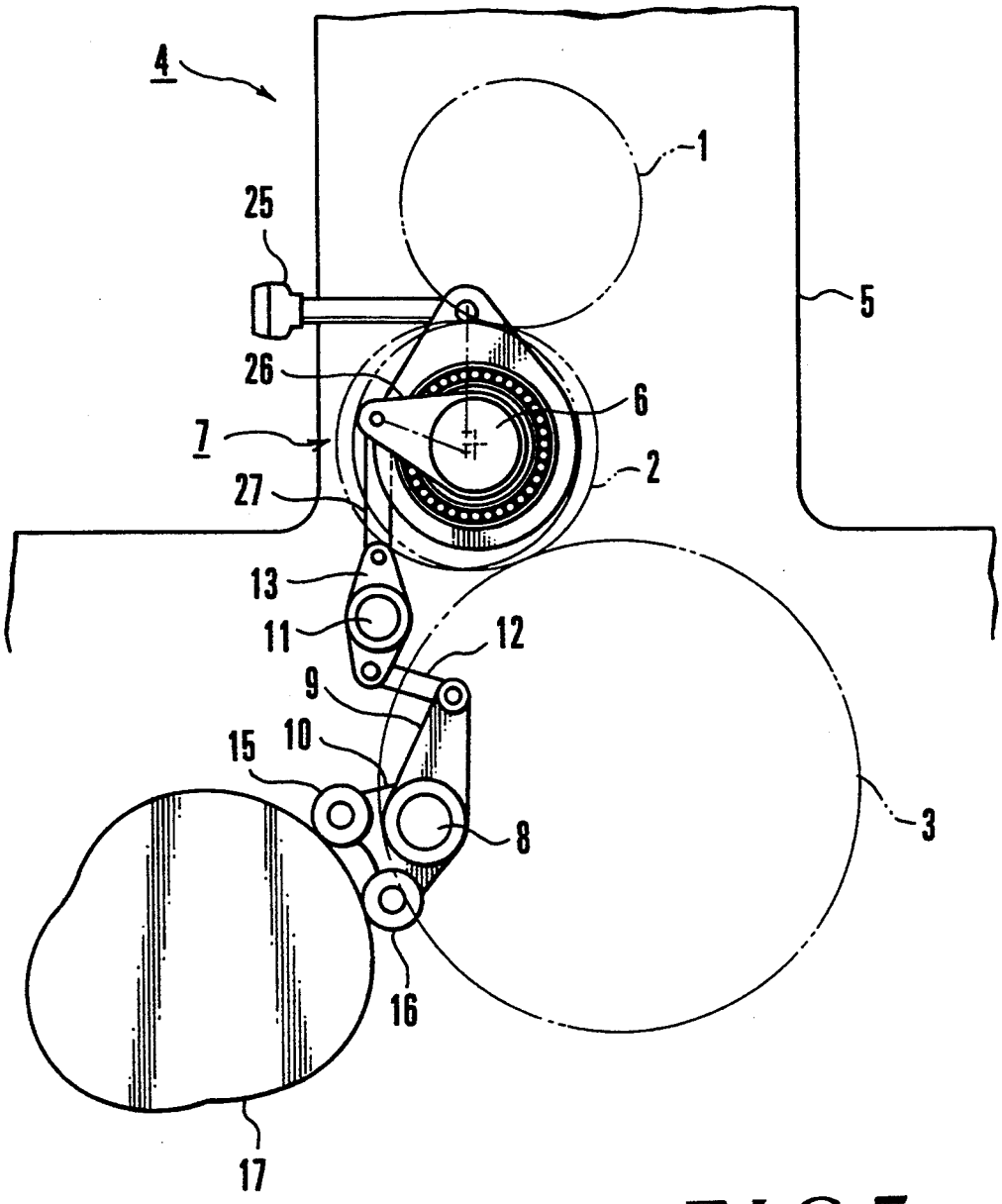
FIG.5 PRIOR ART
FIG. 5 is a side view of a conventional cylinder throw apparatus.
Figure 6:
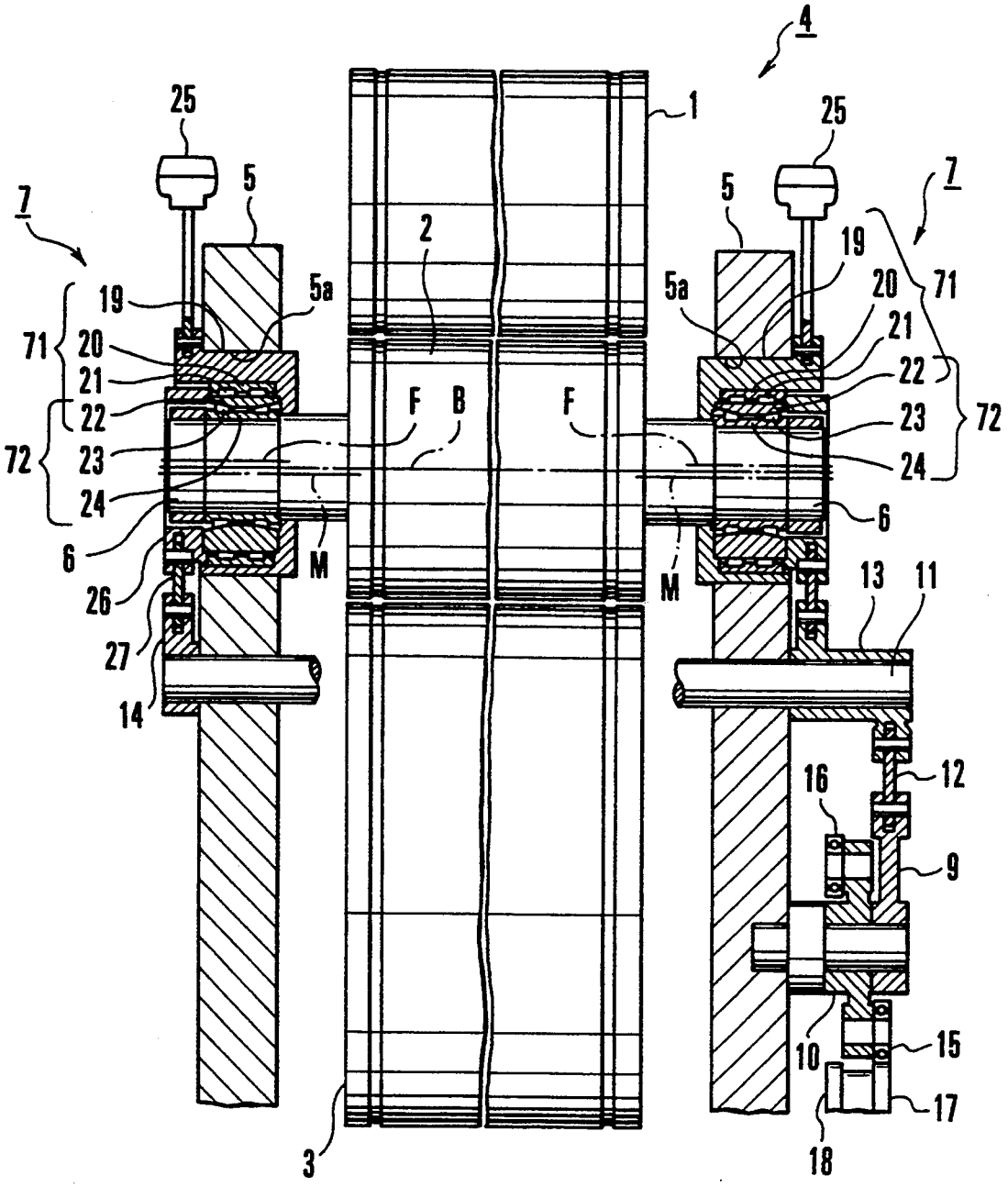
FIG.6 PRIOR ART
FIG. 6 is a partially cutaway developed front view showing the conventional cylinder throw apparatus.
Figure 7:
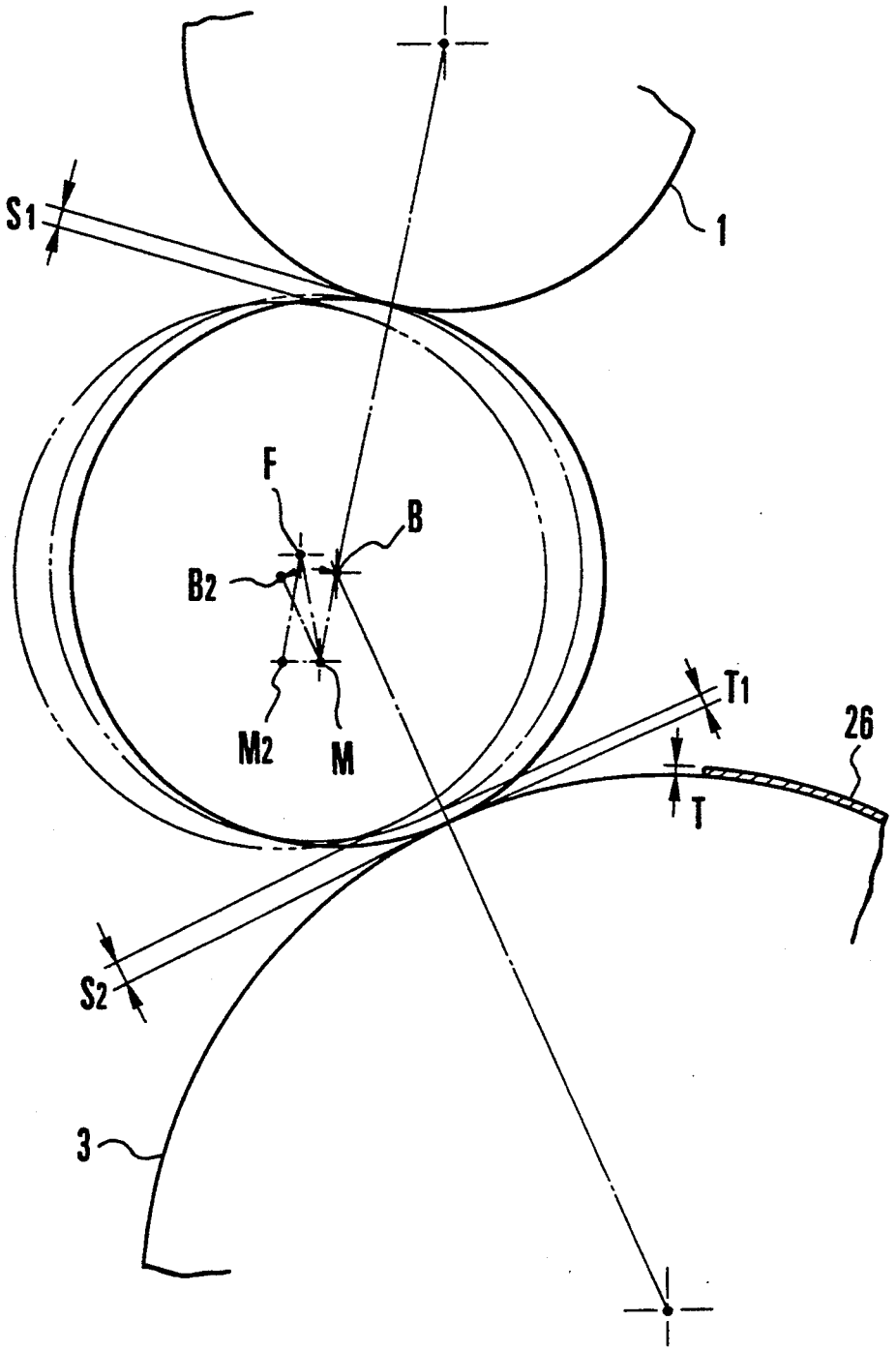
FIG.7 PRIOR ART
FIG. 7 is a schematic side view for explaining the movement of the axis of a blanket cylinder by the pivotal movement of eccentric bearings of the conventional cylinder throw apparatus.

FIGS. 1 to 4 show a cylinder throw apparatus according to an embodiment of the present invention, in which FIGS. 1 and 2 show the cylinder throw apparatus, FIG. 3 shows the movement of the axis of a blanket cylinder by the pivotal movement of eccentric bearings, and FIG. 4 shows a cylinder throw operation.

Referring to FIGS. 1 to 3, for example, an offset rotary press comprises a plate cylinder 31, a blanket cylinder 32, and an impression cylinder 33. A printing plate is mounted on the circumferential surface of the plate cylinder 31. The blanket cylinder 32 having a blanket mounted on its circumferential surface is in contact with the plate cylinder 31 during the printing operation. The impression cylinder 33 is in contact with the blanket cylinder 32 during the printing operation. Of these printing cylinders 31, 32, and 33, the plate cylinder 31 and the impression cylinder 33 have shafts rotatably supported, through bearings (none are shown), on left and right frames 35 provided to a printing unit 34, respectively. A shaft 36 of the blanket cylinder 32 is rotatably supported by eccentric bearings 37 (to be described later in detail) fitted in the left and right frames 35. More specifically, the positions of the shafts of the plate cylinder 31 and the impression cylinder 33 are fixed with respect to the left and right frames 35. On the other hand, the position of the shaft 36 of the blanket cylinder 32 is movable with respect to the left and right frames 35.

A bracket 39 is supported by a stud 38 projecting outward from one of the frames 35 near the end shaft of the impression cylinder 33. A motor 40 serving as a driving apparatus is fixed on the bracket 39 with a driving rod 41 standing upright. The motor 40 is connected to a controller 52 through control lines 53. The controller 52 controls the rotational amount of the motor 40 in correspondence with an input paper thickness. Upon rotation of the motor 40, a nut **40*a* is rotated to cause the driving rod 41 having a screw portion threadably engaged with the nut 40*a* to move in the vertical direction. A lever shaft 42 having two ends axially supported on the left and right frames 35 is located above the driving rod 41. A coupling lever 43 having an L-shaped form when viewed from the front is axially mounted on one projecting portion of the lever shaft 42. Another coupling lever 44 is axially mounted on the other projecting portion of the lever shaft 42**.

The eccentric bearings 37 are rotatably supported, through needle rollers 46, by housings 45 fitted and fixed on bearing holes **35*a* in the frames 35 by bolts, respectively. The eccentric bearings 37 comprise outer rings 47 fitted in the housings 45 through the needle rollers 46, and inner rings 49 rotatably fitted in the outer rings 47 through conical rollers 48**, respectively.

Bearing levers 50 fixed to the outer rings 47 of the left and right eccentric bearings 37 are coupled to the driving rod 41 through the coupling levers 43 and 44 and rods 51, all of which constitute a link mechanism. When the driving rod 41 is moved upon rotation of the motor 40, the eccentric bearings 37 of the both sides are pivoted through the coupling levers 43 and 44, the rods 51, and the bearing levers 50 while rolling the needle rollers 46.

Referring to FIG. 2, reference symbol B denotes an axis of the inner circumferential surfaces of the inner rings 49 constituting the eccentric bearings 37, i.e., an axis of the blanket cylinder 32 in the impression-on state. Reference symbol F denotes an axis of the outer circumferential surfaces of the outer rings 47 of the eccentric bearings 37 (to be referred to as axis of the eccentric bearings 37). The axis B and the axis F are offset from each other by a predetermined distance. In the cylinder throw apparatus of this embodiment, the operation of each unit is controlled by the controller 52 or another controller at a predetermined timing.

Referring to FIG. 3 showing the impression-on state, an axis P of the plate cylinder 31 and the axis B of the blanket cylinder 32 are kept away from each other by a distance such that a proper printing pressure can be obtained. The axis B of the blanket cylinder 32 and an axis I of the impression cylinder 33 are kept away from each other by a distance, considering a thickness t of printing paper 60, such that a proper printing pressure can be obtained.

When the impression throw-off operation is performed upon ending of the printing operation, the axis B of the blanket cylinder 32 is pivoted about the axis F of the eccentric bearings 37 to be moved to the position indicated by reference symbol $B_2$ in FIG. 3. As a result, the distance between the axis P of the plate cylinder 31 and the axis $B_2$ of the blanket cylinder 32 is increased to form a gap $S_1$. Similarly, the distance between the axis $B_2$ of the blanket cylinder 32 and the axis I of the impression cylinder 33 is increased to form a gap $S_2$, thereby obtaining the impression throw-off state. If the printing operation is restarted, the axis $B_2$ of the blanket cylinder 32 is pivoted clockwise about the axis F of the eccentric bearings 37 in FIG. 3, thereby obtaining the impression-on state.

If the thickness t of the printing paper 60 is changed, the axis of the blanket cylinder 32 is moved from B to $B_1$ in consideration of the new thickness to obtain a proper printing pressure. As a result, a gap indicated by reference symbol $t_1$ in FIG. 3 is formed between the blanket cylinder 32 and the impression cylinder 33, thereby obtaining a proper printing pressure corresponding to the new paper thickness. Upon ending of the printing operation, the axis of the blanket cylinder 32 is moved from $B_1$ to $B_2$ to obtain the impression throw-off state, as described above.

An operation of the cylinder throw apparatus of the above arrangement will be described with reference to the flow chart of FIG. 4. Before the printing operation is started, as preparation, the paper thickness t is input to the controller 52 for setting (step S101). The controller 52 determines the gap between the blanket cylinder 32 and the impression cylinder 33, i.e., the stop position of the driving rod 41, in correspondence with the input paper thickness t by calculation, thereby determining the rotational amount of the motor 40 (step S102). In this case, the rotational amount of the motor 40 is equivalent to the rotational amount required to move the axis of the blanket cylinder 32 from the position $B_2$ to the position B. Not only the rotational amount of the motor for impression-on, also the paper thickness is taken into consideration to determine the rotational amount. An operation start timing signal for cylinder throw is output from a printing press timing detector (not shown).

After preparation, the printing press is operated, and the printing paper is supplied (step S103). The impression-on operation timing signal is output at a predetermined timing on the basis of an output from, e.g., a rotary encoder (not shown) serving as the printing press timing detector (step S104). The motor 40 is rotated at the rotational amount determined by the previous calculation (step S105). When the motor 40 is rotated, the driving rod 41 is moved in the vertical direction. The eccentric bearings 37 of the both sides are moved on the arc centered on the axis F of the eccentric bearings 37 through the coupling levers 43 and 44, the rods 51, and the bearing levers 50 while rolling the needle rollers 46. The axis of the blanket cylinder 32 is moved from the position $B_2$ to the position B, thereby completing impression-on including position adjustment by the paper thickness (step S106).

When paper feeding is started in this impression-on state, the image transferred from the plate mounted on the circumferential surface of the plate cylinder 31 to the blanket on the blanket cylinder 32 is transferred to the paper 60 passing between the blanket and impression cylinders 32 and 33 with the gap being adjusted, thereby performing printing.

Upon ending of the printing operation, the impression throw-off operation timing signal is output at a predetermined timing (step S107) to reversely rotate the motor 40 (step S108). The axis of the blanket cylinder 32 is moved from B to $B_2$, thereby completing impression throw-off (step S109) and stopping the printing press (step S110). Steps S103 to S110 are repeated during the printing operation thereafter unless the paper thickness is changed.

If the paper 60 is replaced with, e.g., the thick paper having the thickness indicated by reference symbol t in FIG. 3 (step S111), the flow returns to step S101 to input the new paper thickness t to the controller 52. Thereafter, the same operation as the above is performed in steps S102 to S110. At this time, in step S105 of impression-on, the impression-on operation of the blanket cylinder 32 is performed at the position corresponding to the paper thickness t in accordance with the newly calculated motor rotational amount.

In this embodiment, the rotation timing of the motor 40 is automatically controlled on the basis of the output from the printing press timing detector. However, the timing is not necessarily automatically controlled. The motor 40 may be started to rotate by a push button operation or the like.

In addition, in this embodiment, the impression cylinder 33 is exemplified as the printing cylinder with respect to which the impression-on/impression throw-off operation of the blanket cylinder 32 is performed. However, it is not limited to this. The impression-on/impression throw-off operation of the blanket cylinder may be freely performed with respect to a blanket cylinder. Furthermore, the present invention may be applied to the blanket cylinder of a printing press having a structure in which a plurality of blanket cylinders are provided to freely perform the impression-on/impression throw-off operation with respect to the circumferential surface of an impression cylinder.

As has been apparent from the above description, according to the present invention, the blanket cylinder is moved between the impression-on position and the impression throw-off position by one driving apparatus. At the same time, the gap between the blanket cylinder and the printing cylinder at the impression-on position is set in correspondence with the paper thickness. Therefore, two inner and outer pairs of eccentric bearings conventionally required can be reduced to one pair thereof. In addition, a simple structure can be realized to reduce the number of components, and a low-cost apparatus can be provided because the conventional cam is not required.

Cylinder throw and paper thickness adjustment can be sequentially performed by one driving system to improve the efficiency and allow a simpler structure. Setting and adjustment of the cylinder throw timing, which are impossible in the conventional cam apparatus, can easily be performed. Cylinder throw of each printing unit in a multicolor printing press can be simultaneously performed, thereby shortening the preparation time to greatly improve the operating ratio of the printing press.

What is claimed is:

1. A cylinder throw apparatus comprising:

a plate cylinder having a circumferential surface on which a printing plate is mounted;

a printing cylinder disposed to have a circumferential surface thereof kept away from said circumferential surface of said plate cylinder;

a blanket cylinder disposed between said plate cylinder and said printing cylinder; and driving means for moving said blanket cylinder between an impression-on position in which said blanket cylinder is pressed against said plate cylinder and, through a paper sheet, pressed against said printing cylinder, and an impression throw-off position in which said blanket cylinder is kept away from said plate cylinder and said printing cylinder, and automatically setting a gap between said blanket cylinder and said printing cylinder at the impression-on position in correspondence with a paper thickness, wherein said driving means comprises one pair of eccentric bearings, pivotally provided to a left frame and a right frame, for supporting two ends of said blanket cylinder; and a control means for calculating a value indicating a moving amount of said blanket cylinder from the impression throw-off position to the impression-on position in correspondence with the input paper thickness, and for controlling an operating of said driving means on the basis of the calculated value, wherein moving the blanket cylinder between the impression-on and impression throw-off positions and adjusting the blanket cylinder to the printing cylinder for paper thickness are both performed by said one pair of eccentric bearings.

2. An apparatus according to claim 1, wherein said converting means comprises a driving rod moved in accordance with the rotation of said rotation means, and a line means for transmitting a moving amount of said driving rod to said eccentric bearings as the pivot amount.

3. An apparatus according to claim 1, wherein said driving means comprises a motor for moving said blanket cylinder, and said control means calculates, as the value indicating the moving amount of said blanket cylinder, a rotational amount of said motor.

4. An apparatus according to claim 1, wherein the driving means further comprises rotation means whose rotational amount is controlled in correspondence with the paper thickness, and a converting mechanism for converting the rotational amount of said rotation means to a pivot amount of said one pair of eccentric bearings.

* * * * *